US005624504A

United States Patent [19]

Miyakusu et al.

[11] Patent Number: 5,624,504

[45] Date of Patent: Apr. 29, 1997

[54] DUPLEX STRUCTURE STAINLESS STEEL HAVING HIGH STRENGTH AND ELONGATION AND A PROCESS FOR PRODUCING THE STEEL

[75] Inventors: Katsuhisa Miyakusu, Shinnanyo; Yukio Oda, Sakai; Takashi Igawa, Kuga-gun, all of Japan

[73] Assignee: Nisshin Steel Co., Ltd., Tokyo, Japan

[21] Appl. No.: 481,489

[22] PCT Filed: Nov. 10, 1994

[86] PCT No.: PCT/JP94/01894

§ 371 Date: Jul. 11, 1995

§ 102(e) Date: Jul. 11, 1995

[87] PCT Pub. No.: WO95/13405

PCT Pub. Date: May 18, 1995

[30] Foreign Application Priority Data

Nov. 12, 1993 [JP] Japan ..... 5-306105

[51] Int. Cl.[6] ..... C22C 38/32; C21D 8/00

[52] U.S. Cl. ..... 148/325; 148/610; 148/654

[58] Field of Search ..... 148/325, 610, 148/654

[56] References Cited

U.S. PATENT DOCUMENTS 4,824,491 4/1989 Tanaka et al. ..... 148/325

FOREIGN PATENT DOCUMENTS

| | | |
|---|---|---|
| 63-7338 | 1/1988 | Japan . |
| 63-169330 | 7/1988 | Japan . |
| 63-169335 | 7/1988 | Japan . |
| 63-169331 | 7/1988 | Japan . |
| 63-169334 | 7/1988 | Japan . |
| 1-172525 | 7/1989 | Japan . |
| 1-172524 | 7/1989 | Japan . |

*Primary Examiner*—Deborah Yee

*Attorney, Agent, or Firm*—Lowe, Price, LeBlanc & Becker

[57] ABSTRACT

A high strength and elongation stainless steel with a hardness of at least HV is formed of a duplex structure comprising 20% to 95% by volume of martensite having an average grain diameter of not more than 10 μm, with the balance being essentially ferrite, the steel including, by weight, up to 0.10% C, up to 2.0% Si, up to 4.0% Mn, up to 0.040% P, up to 0.010% S, up to 4.0% Ni, from 10.0% to 20.0% Cr, up to 0.12% N, more than 0.0050% to 0.0300% B, up to 0.02% O and up to 4.0% Cu, and optionally contains up to 0.20% Al, up to 3% Mo, up to 0.20% REM, up to 0.20% Y, up to 0.10% Ca, and up to 0.10% Mg, with the balance being Fe and unavoidable impurities.

9 Claims, No Drawings

DUPLEX STRUCTURE STAINLESS STEEL HAVING HIGH STRENGTH AND ELONGATION AND A PROCESS FOR PRODUCING THE STEEL

FIELD OF THE INVENTION

The present invention relates to a high strength and elongation stainless steel having a dual phase structure consisting essentially of ferrite and martensite that has good manufacturability and workability, and to a process for producing the steel, providing a high strength stainless steel that is suitable for use as a material for forming into shapes, such as by press-forming.

BACKGROUND OF THE FIELD

Chromium stainless steels containing chromium as a main alloying element are classified into martensitic and ferritic stainless steels. Compared with austenitic stainless steel containing a relatively high amount of nickel, they are inexpensive and feature such properties as ferromagnetism and a low coefficient of thermal expansion. There are therefore many applications in which chromium stainless steels are used not only for economical reasons but also for their properties.

Particularly in the field of electronic instruments and precision machine parts where such chromium stainless steels are used, along with the increasing demand of recent years, the requirements for steel sheet materials are becoming more rigorous. Steel sheet materials are required that possess combinations of properties that may be in conflict, such as for example high strength and high elongation, and good shape and thickness precision before working together with good shape precision after working.

Conventional chromium stainless steels having high strength include martensitic stainless steels. For example, seven types of martensitic stainless steel are prescribed in the cold rolled stainless steel sheets and strips of JIS G 4305. The prescribed carbon content of these martensitic stainless steels ranges from up to 0.08% (for SUS410S) to 0.60–0.75% (for SUS440A), a high C content compared with ferritic stainless steels of the same Cr level. High strength can be imparted to these steels by quenching treatment or by quenching and tempering treatment. As indicated by the name, the structure of martensitic stainless sheets subjected to such heat treatment is basically martensitic. While this gives the steel great strength (hardness), elongation is extremely poor.

Accordingly, as martensitic steel that has been quenched (or quenched and tempered) has poor workability, steel manufacturers usually ship the material in the annealed state, that is, as soft ferritic steel sheet or strip having low strength and hardness, to a processor where the material is worked into product shape and is then subjected to quenching or quenching and tempering treatment.

In many cases surface oxide film or scale formed by the post-forming heat treatment is undesirable with stainless steel in which the emphasis is on surface attractiveness. As a countermeasure, it therefore becomes necessary to carry out the heat treatment in a vacuum or in an inert gas atmosphere, and to pickle and/or polish the steel after the heat treatment. Thus, using martensitic steel has tended to increase the burden on the side of the processor, unavoidably increasing the cost of the final product.

On the other hand, ferritic stainless steel has never been used much in applications requiring high strength, and hardening by heat treatment has not been much expected. In some cases annealing is followed by work hardening using temper rolling (cold rolling) to obtain ferritic stainless steel having high strength. In this case the steel is used in the cold rolled state, and a problem is that while increasing the rolling reduction rate increases the strength, above a certain point the result is a marked degradation in the elongation, meaning there is an upper limit to the level of strength at which a certain degree of workability can be maintained.

The properties of SUS430 strengthened by cold rolling at 20–30%, for example, show a poor strength-elongation balance, with a hardness of around HV 230 and no more than 2 or 3% elongation. Moreover, using temper rolling to obtain wide material formed to a good shape is itself difficult, and the material exhibits considerable plane anisotropy regarding strength and elongation, making it difficult to obtain good shape precision after working.

To solve the above problems of conventional high strength chromium stainless steels, the present inventors have proposed, for example in JP-A-63-7338, JP-A-63-169330 to JP-A-63-169335, JP-A-1-172524 and JP-A-1-172525, a process for the production of a strip of a chromium stainless steel of a duplex structure consisting essentially of ferrite and martensite and having high strength and elongation, which process comprises the steps of basically hot rolling and cold rolling a slab of a steel to provide steel strip, said steel having a composition adjusted to form a structure of ferrite and austenite at high temperature, continuous finish heat treatment in which the steel strip is heated to an appropriate temperature above the $Ac_1$ point of the steel to form a two-phase of ferrite and austenite and maintained at that temperature, and the heated strip is cooled at an appropriate cooling rate to transform the austenite to martensite.

OBJECT OF THE INVENTION

The duplex structure chromium stainless steel strip according to this invention has fully sufficient properties for use as a high strength material for forming into shapes, i.e., a good balance between strength and elongation, low plane anisotropy with respect to strength and elongation and a low yield strength and yield ratio, thus solving all the problems of conventional high strength chromium stainless steels.

However, in the manufacturing process there are cases in which such duplex structure stainless steel strip exhibit a hot workability that is inferior to that of conventional ferritic and martensitic stainless steels. This is because the duplex structure stainless steels are hot rolled in a state of coexistence of ferrite and austenite, which exhibit basically different deformabilities and deformation resistances during hot rolling, and the hot workability is affected by the ratio and high-temperature strength of the two phases. Taking for example the ratio of the two phases, at high temperatures duplex structure stainless steels have less ferrite than conventional ferritic stainless steels, which tends to degrade the hot workability. On the other hand, with stainless steels with a completely martensitic structure that forms single-phase austenite during hot rolling, this degradation of hot workability owing to the coexistence of the two phases does not constitute a problem.

Degradation of the hot workability can give rise to fine cracking at edge portions of the steel strip during hot rolling. Fine cracking at edge portions (hereinafter also referred to simply as "edge cracking") of hot rolled steel strip occurs particularly when the proportion of martensite is increased for higher strength, that is, when a composition balance is used that increases the amount of austenite formed at high temperatures.

Although edge cracking does not adversely affect the properties of the material, it can cause breakage of the steel strip during the cold rolling step that follows. It is therefore necessary to remove edge cracking prior to the cold rolling, which tends to reduce the width yield. To prevent this happening the number of hot rolling passes can be raised, as required, reducing the rolling rate of reduction per pass. However, this is all a hindrance to the economic aspects that are a feature of duplex structure stainless steel strips. The object of the present invention is to solve such problems.

DISCLOSURE OF THE INVENTION

In accordance with this invention, there is provided high strength and elongation stainless steel having a duplex structure of from 20% to 95% by volume of martensite with an average grain diameter of not more than 10 μm, with the balance being essentially ferrite, and having a hardness of at least HV 200, said steel comprising, by weight:

up to 0.10% C,
up to 2.0% Si,
up to 4.0% Mn,
up to 0.040% P,
up to 0.010% S,
up to 4.0% Ni,
from 10.0% to 20.0% Cr,
up to 0.12% N,
more than 0.0050% to 0.0300% B,
up to 0.02% O, and
up to 4.0% Cu, and optionally containing one or more selected from up to 0.20% A1, up to 3% Mo, up to 0.20% REM, up to 0.20% Y, up to 0.10% Ca, and up to 0.10% Mg, to satisfy $0.01\% \leqq C + N \leqq 0.20\%$ $0.20\% \leqq Ni + (Mn + Cu)/3 \leqq 5.0\%$, the balance being Fe and unavoidable impurities.

In accordance with this invention, cold rolled steel strip is produced from the above composition-controlled steel slab by a hot rolling step comprising rough rolling and finish rolling, and a cold rolling step. The cold rolled strip is then subjected to dual-phase heat treatment comprising passing the strip through a continuous heat treatment furnace where it is heated to a temperature ranging from at least 100° C. above the $Ac_1$ point of the steel to 1100° C. to form a two-phase of ferrite and austenite and maintained at that temperature for not longer than 10 minutes, and cooling it from the maximum heating temperature to ambient temperature at an average cooling rate of from at least 1° C./s to not more than 1000° C./s, thereby producing stainless steel strip having the above duplex structure and hardness. With respect to the content amounts of C, N, Ni, Mn, Cu, Cr, and Si in the steel of the composition of this invention, in accordance with the equation $$\gamma max = 420(\%\ C) + 470(\%\ N) + 23(\%\ Ni) + 7(\%\ Mn) + 9(\%\ Cu) - 11.5(\%\ Cr) - 11.5(\%\ Si) + 189 \quad (1)$$

the values of γmax can be divided into case A) when content values are used to satisfy a relationship of up to 65, and case B) when content values are used to satisfy a relationship of more than 65 to not more than 95. For the former, case A), the martensite content in the duplex structure is from 20% to not more than 70% by volume and the hardness is at least HV 200. For the latter, case B), the martensite content in the duplex structure is from 60% to not more than 95% by volume and the hardness is at least HV 320.

In the hot rolling process, material according to case A can be given four or more rough rolling passes at a reduction rate of at least 30% per pass, while material according to case B can be given three or more rough rolling passes at a reduction rate of at least 30%.

DETAILED DESCRIPTION OF THE INVENTION

Based on extensive research into the production of steel having a duplex structure of ferrite and martensite in the strip form, to find what compositional balance would provide such a duplex structure without giving rise to edge cracking, the present inventors discovered the composition and manufacturing conditions that enable this object to be attained.

The reasons for the limitations on the chemical components of the steel specified by the invention, and the steps of the manufacturing process, will now be described in specific detail together with the function thereof.

C and N are strong and inexpensive austenite formers when compared with Ni, Mn, Cu and the like, and have an ability to greatly strengthen martensite. Accordingly, they are effective to control and increase the strength of the product subjected to heat treatment in a continuous heat treatment furnace to obtain a duplex structure. Thus, to obtain a duplex structure from the continuous heat treatment step that consists essentially of ferrite and martensite having the required high strength and good elongation, it is necessary to add at least 0.01% (C+N) even when austenite formers such as Ni, Mn and Cu are added. However, an excessively high (C+N) content will increase the amount of martensite formed by the heat treatment, perhaps even to the extent that the structure becomes 100% martensitic, and the hardness of the martensite phase itself becomes unduly high, so that while high strength may be attained, elongation is degraded. It is therefore necessary for the (C+N) content to be up to 0.20%, and to satisfy the condition $0.01\% \leqq (C+N) \leqq 0.20\%$.

A high C content tends to reduce toughness and have an adverse effect on manufacturability and product properties. Also, in the dual-phase heat treatment in which, using a continuous heating furnace, the steel is heated to a temperature at which a two-phase structure of ferrite and austenite is formed and is then quenched, during the cooling step Cr carbides dissolved during the heating reprecipitate at ferrite and austenite (martensite;, after cooling) grain boundaries, so-called sensitization, and the resultant layer of chromium depletion in areas immediately adjacent to grain boundaries markedly reduces corrosion resistance. Hence, a C content of up to 0.10% has been specified.

Solubility factors makes it difficult to add a high amount of N, and high added N can cause an increase in surface defects. Thus, the upper limit for N has been set at 0.12%.

Si is a ferrite former and also acts as a powerful solid solution strengthener in both the ferritic and the martensitic phases. As such, Si is effective for controlling the amount of martensite, and the degree of strength. The upper limit for Si is set at 2.0%, since adding a large amount of Si adversely affects hot and cold workability.

Mn, Ni and Cu are austenite formers and are effective for controlling the strength of the steel and the amount of martensite after dual-phase heat treatment. Moreover, adding Ni, Mn or Cu makes it possible to reduce the C content. By producing a softer martensite, this improves the elongation and, by suppressing precipitation of Cr carbides at grain boundaries, also makes it possible to prevent degradation of corrosion resistance caused by sensitization.

Ni, Mn and Cu also have the effect of markedly lowering the $Ac_1$ point of the steel, that is, the temperature at which the austenitic phase starts to form during heating. This has a major significance in terms of improving the workability of the fine mixed structure (of ferrite and martensite) that is a feature of this invention.

In the duplex structure stainless steel at which this invention is directed, the duplex structure is obtained by the production of an austenite phase in a ferrite matrix during dual-phase heat treatment that follows the cold rolling. In order to obtain a fine structure, it is necessary to finely distribute the austenite phase that is formed. To do this, (1) it is important to effect dual-phase heat treatment of the steel in the as-cold-rolled state by rapid heating in a continuous heating furnace and form the austenite at the same time in the ferrite matrix (i.e., to increase the austenite nuclei formation sites) in which there is residual strain from the cold rolling. An effective way of accomplishing this more actively is (2) to use constituents having an $Ac_1$ point that is close to, or not higher than, the ferrite phase recrystallization temperature. For this, it is both necessary and effective to add Ni, Mn or Cu, as these elements lower the $Ac_1$ point.

Even when dual-phase heat treatment of the steel in the as-cold-rolled state is applied, in cases where the $Ac_1$ point is quite higher than the ferrite phase recrystallization temperature, the onset of austenite formation takes place after full recrystallization of the ferrite phase. In such a case, austenite nuclei formation sites are limited to the ferrite grain boundaries, resulting in enlargement of the martensite.

Ni has the greatest effect on austenite forming ability per unit mass percent and on the $Ac_1$ point; Mn or Cu has only about one-third the effect that Ni has. Therefore, the formula Ni+(Mn+Cu)/3 is used to determine the amount of Ni, Mn and Cu to add to obtain the above effect, for which said added amount needs to be at least 0.2%. On the other hand, adding a large amount of Ni would make the product uneconomically costly. Therefore, the content of each of Ni, Mn and Cu on an individual basis is set at up to 4.0%, and at up to 5.0% in the case of Ni+(Mn+Cu)/3.

P is an element that has a powerful solid solution strengthening effect, but as it can also have an adverse effect on toughness, it is limited to no more than 0.040%, the amount permitted in normal practice.

The lower the S content the better, since this is an element that is undesirable with respect to edge cracking and corrosion resistance. With a S content of less than 0.0010%, there is no edge cracking, even without the addition of B, described below. However, since in the case of a commercial-scale steel manufacturing reducing S to a stably ultralow level would actually have the effect of increasing the manufacturing cost, an upper limit of 0.010% S is permitted.

Cr is the most important element with respect to the corrosion resistance of stainless steel, and must be contained in an amount of at least 10.0% to achieve the desired level of corrosion resistance for a stainless steel. However, too high a Cr content increases the amounts of austenite formers required to form the martensite phase and achieve high strength, raises the product cost, and reduces toughness and workability. Accordingly, the upper limit for Cr is set at 20.0%.

The addition of B is an important part of this invention, because it is highly effective for preventing edge cracking in the hot rolled steel strip of this invention. This effect also makes it possible to increase the reduction rate per hot rolling pass, which improves production efficiency by reducing the number of rough rolling passes.

Edge cracking in the duplex structure stainless steel strip of this invention is caused by differences between the deformability and deformation resistance (high-temperature strength) of the ferrite and austenite phases at the hot-rolling temperature region. Cracking occurs at the interface between the phases during hot rolling when, as a result of the differences, the burden on the interface between the phases becomes too large for the interface to match the deformation. Another contributory factor is embrittlement occurring at the phase interface resulting from the quantitative ratios of the two phases and S segregation at the interface boundary. B has the effect of inhibiting this. Although it is not yet clear why B has this effect, it might be that as boron itself has a tendency toward boundary segregation, the addition of boron reduces S segregation, or it might be that the boron itself increases the strength of the interface. A boron content of 0.0050% or less may not effectively prevent edge cracking, while more titan 0.0300% may cause deterioration of surface properties. Thus, a boron content of more than 0.0050% to not more than 0.0300% is specified.

O forms oxide non-metallic inclusions, which impairs the purity of the steel, and has an adverse affect on bendability and press formability, so the 0 content has been set at not more than 0.02%.

A1 is effective for deoxygenation during the steel-making process, and serves to remarkably reduce $A_2$ inclusions which adversely affect the press formability of the steel. However, an A1 content that exceeds 0.20% has a saturation effect and tends to increase surface defects, so 0.20% has been set as the upper limit for A1.

Mo is effective for enhancing the corrosion resistance of the steel. However, a high Mo content degrades hot workability and increases product cost, so the upper limit for Mo has been set at 3.0%.

REM (rare earth metals), Y, Ca and Mg are effective elements for improving hot workability and oxidation resistance. However, in each case the effect is saturated if too much is added. Accordingly, an upper limit of 0.20% has been set for REM and for Y, and an upper limit of 0.10% has been set for Ca and for Mg.

The $\gamma max$ value calculated according to equation (1) is an index corresponding to the maximum amount, in percent, of austenite at high temperature. It therefore follows that $\gamma max$ controls the amount of martensite formed after the dual-phase heat treatment and affects the hot workability. With a $\gamma max$ that does not exceed 65, edge cracking does not constitute much of a problem, while improved hot workability resulting from reduced S and the addition of B makes it possible to perform the hot rough rolling using four or more passes at a reduction rate of at least 30% per pass, thereby enabling the number of hot rolling passes to be reduced.

With a $\gamma max$ that exceeds 65, hot workability is reduced, but owing to the decrease in S and the addition of B and also of REM, Y, Ca and Mg, hot rough rolling can be performed in three passes at a reduction rate of at least 30% per pass without giving rise to edge cracking. If $\gamma max$ is too high, the amount of martensite following the dual-phase heat treatment will be close to 100%, with a departure from the object of the duplex structure stainless steel, that of attaining both high strength and high elongation. Therefore, an upper limit of 95 has been set for $\gamma max$.

The amount of martensite following the dual-phase heat treatment is the main factor determining the strength (hardness) of the steel. While an increase in the amount of martensite increases the strength of the steel, the elongation decreases. The maximum amount of martensite that is produced can be controlled, for example, by the compositional balance represented by γmax. Even using identical compositions, the amount of martensite can be varied by the dual-phase heat treatment, in particular by the heating temperature used. If the amount of martensite is less than 20% by volume, it is difficult to attain a hardness of at least HV 200, while on the other hand, more than 95% by volume of martensite results in a major decrease in ductility, hence a low absolute elongation. In each case the significance of the two-phase structure of ferrite and martensite is lost. Thus, the amount of martensite following the dual-phase heat treatment has been set at from not less than 20% to not more than 95% by volume.

The metallographic fineness of the duplex structure steel of this invention has a bearing on the degree of workability. Specifically, a finer structure results in enhanced bending workability. It is possible that this is because with finer grains, local concentrations of processing stresses are alleviated and uniformly dispersed. While it is difficult to definitively define the metallographic size of duplex structure steel, an average martensite grain diameter of not more than 10 μm markedly improves the bending workability, as shown in the examples described below. Thus, not more than 10 μm has been set as an index for the average grain size of the martensite phase.

The manufacturing conditions for the duplex structure steel strip according to this invention will now be described.

A slab of a stainless steel of the above-described adjusted chemical composition is prepared using conventional steelmaking and casting conditions, and is subjected to hot rolling comprising rough rolling and finish rolling, to provide a hot rolled strip. A steel having the composition range prescribed by this invention, with a good rollability γmax of not more than 65, can be subjected to four or more rough rolling passes at an average reduction rate of at least 30% per pass, while a steel with a γmax of from more than 65 to not more than 95 can be subjected to three or more rough rolling passes at an average reduction rate of 30% per pass, thereby enhancing production efficiency and providing hot rolled strip with no edge cracking.

The hot rolled strip is preferably annealed and descaled. Although the annealing is not essential, it is desirable as it not only softens the material to enhance the cold rollability of the hot rolled strip, but also transforms and decomposes intermediately transformed phase (portions which were austenite at the high temperatures) in the hot rolled strip to ferrite and carbides, thereby producing strip that, after cold rolling and dual-phase heat treatment, has a uniform duplex structure. Descaling can be done by a conventional pickling process.

The hot rolled strip is then cold rolled to a product thickness. The cold rolling step may be carried out as a single cold rolling with no intermediate annealing, or as two cold rollings separated by an intermediate annealing. An intermediate annealing increases the cost and is not an essential requirement. However, intermediate annealing is advantageous in that it reduces the plane anisotropy of the product. It is preferable to use an intermediate annealing temperature (material temperature) that is not higher than the $Ac_1$ point of a single phase ferrite formation zone where there is no austenite. If the annealing should however be done above the $Ac_1$ point at which ferrite and austenite are formed, it is desirable to use a temperature zone not above about 850° C. where the proportion of austenite is low.

Dual-phase heat treatment comprises passing the cold rolled strip through a continuous heat treatment furnace to obtain the aforementioned fine structure. Heating the steel at a temperature zone at which a two-phase of ferrite and austenite is formed is an essential condition for obtaining heat treated steel having a mixed structure of ferrite and martensite. In the process of this invention, when the continuous heat treatment furnace is being heated up, at a temperature near the $Ac_1$ point at which the austenite starts to form, changes in temperature can result in large variations in the amount of austenite formed, which is to say, in the amount of martensite formed by the subsequent cooling, so that in some cases a desired hardness (strength) is not stably obtained.

In the composition range of the steel of this invention, substantially such variations in hardness do not arise if a heating temperature of at least about 100° C. above the $Ac_1$ point of the steel is used. Thus, a preferable heating temperature in the dual-phase heat treatment of the invention is at least about 100° C. above the $Ac_1$ point of the steel. If the heating temperature is too high, the hardening effect becomes saturated and may even be decreased, and it is also disadvantageous in terms of cost. Accordingly, the upper limit for the heating temperature has been set at 1100° C.

At a temperature at which a two-phase structure of ferrite and austenite is formed during the dual-phase heat treatment, the austenite formation amount reaches equilibrium within a shoal period of time. Thus, the heating time can be as short as not more than about 10 minutes. The cooling rate in the dual-phase heat treatment should be sufficient to transform the austenite to martensite. For this, a cooling rate of at least 1° C./s is required. A cooling rate above about 1000° C./s is not practical, so a cooling rate of from 1° C./s to 1000° C./s is prescribed. The cooling rate is expressed as an average cooling rate from the maximum heating temperature to the ambient temperature. Once the transformation from austenite to martensite has taken place, it is no longer necessary to employ the said cooling rate.

EXAMPLES

Steels having the chemical compositions shown in Table 1 were vacuum melted to form 400 kg slabs 165 mm thick, 200 mm wide. The slabs were divided into two as required, heated to 1200° C., rough rolled, using the number of passes shown in Table 2, and finish rolled at 920° C. to a finish sheet thickness of 3.6 mm. After the hot rolling the sheets were examined for edge cracking. The results are shown in Table 2

TABLE 1

| Steel No. | C | Si | Mn | P | S | Ni | Cr | N | B | O | Al | Cu | Other | γmax | Category |
|---|---|---|---|---|---|---|---|---|---|---|---|---|---|---|---|
| 1 | 0.035 | 0.40 | 0.22 | 0.028 | 0.0032 | 0.55 | 15.85 | 0.012 | 0.0073 | 0.0069 | 0.005 | 0.42 | | 40.4 | Inventive |
| 2 | 0.029 | 0.56 | 0.26 | 0.027 | 0.0010 | 1.54 | 16.28 | 0.011 | 0.0061 | 0.0032 | 0.021 | 0.04 | | 50.3 | " |
| 3 | 0.077 | 1.45 | 0.82 | 0.017 | 0.0028 | 0.34 | 17.06 | 0.025 | 0.0065 | 0.0043 | 0.018 | 2.25 | | 54.0 | " |

TABLE 1-continued

| Steel No. | C | Si | Mn | P | S | Ni | Cr | N | B | O | Al | Cu | Other | γmax | Category |
|---|---|---|---|---|---|---|---|---|---|---|---|---|---|---|---|
| 4 | 0.063 | 0.50 | 2.30 | 0.029 | 0.0019 | 1.03 | 16.15 | 0.063 | 0.0220 | 0.0035 | 0.022 | 0.12 | Mo: 2.06 | 69.7 | " |
| 5 | 0.065 | 0.53 | 0.31 | 0.024 | 0.0015 | 2.01 | 16.21 | 0.009 | 0.0094 | 0.0061 | 0.011 | 0.03 | Ca: 0.008 Mg: 0.01 | 80.0 | " |
| 6 | 0.042 | 0.41 | 0.83 | 0.025 | 0.0012 | 0.31 | 11.97 | 0.012 | 0.0085 | 0.0064 | 0.007 | 0.05 | | 83.3 | " |
| 7 | 0.076 | 0.52 | 0.27 | 0.026 | 0.0005 | 2.58 | 16.40 | 0.010 | 0.0071 | 0.0023 | 0.042 | 0.05 | REM: 0.04 Y: 0.07 | 92.7 | " |
| 8 | 0.089 | 0.52 | 0.20 | 0.023 | 0.0027 | 0.05 | 16.30 | 0.054 | 0.0067 | 0.0054 | 0.009 | 0.03 | | 61.2 | Comparative |
| 9 | 0.032 | 0.52 | 0.30 | 0.027 | 0.0016 | 1.48 | 16.31 | 0.008 | 0.0002* | 0.0065 | 0.007 | 0.05 | | 49.2 | " |
| 10 | 0.080 | 0.54 | 0.28 | 0.022 | 0.0024 | 2.03 | 16.32 | 0.011 | 0.0014 | 0.0072 | 0.005 | 0.05 | | 81.2 | " |
| 11 | 0.091 | 0.55 | 0.31 | 0.027 | 0.0047 | 2.25 | 16.42 | 0.013 | 0.0003* | 0.0033 | 0.010 | 0.04 | | 92.5 | " |

*Not added

TABLE 2

| Category | Example No. | Steel No. | Rough rolling passes*1 | Edge Cracking*2 |
|---|---|---|---|---|
| Inventive | 1 | 1 | (5/5) | ○ |
| | 2 | 2 | (3/7) | ○ |
| | 3 | 2 | (5/5) | ○ |
| | 4 | 3 | (5/5) | ○ |
| | 5 | 4 | (3/7) | ○ |
| | 7 | 5 | (3/7) | ○ |
| | 8 | 6 | (3/7) | ○ |
| | 9 | 7 | (3/7) | ○ |
| Comparative | 1 | 8 | (3/7) | ○ |
| | 2 | 9 | (3/7) | ○ |
| | 3 | 9 | (5/5) | X |
| | 4 | 10 | (3/7) | X |
| | 5 | 11 | (3/7) | X |

*1(No. of passes at reduction of 30% or more/Total no. of passes)
*2○: No edge cracking
X: Edge cracking As can be seen from the results in Table 2, inventive steels Nos. 1 to 7 could be hot rolled without edge cracking occurring, even in the cases of steels Nos. 1 to 3, formed using a γmax value not exceeding 65 and rough rolled at high reduction rates.

In contrast, high-reduction rough rolling of comparative steel No. 9 resulted in edge cracking, showing it to have inferior hot workability compared to inventive steel No. 2 which has substantially the same γmax. Comparative steels Nos. 10 and 11 also showed edge cracking, owing to their low boron content, showing them to have inferior hot workability compared to inventive steels Nos. 5 and 7, respectively, with virtually the same γmax.

Hot rolled strips of inventive steels Nos. 1 to 7 that exhibited no hot workability problems, and inventive steel No. 8, were then annealed by heating at 780° C. for 6 hours and cooling in-furnace, pickled, and cold rolled to form strip 0.7 mm thick. The cold rolled strips were then subjected to dual-phase heat treatment in a continuous heat treatment furnace, using the conditions shown in Table 3, which also shows the material properties thus obtained.

TABLE 3

| | | | Dual-phase Heat Treatment | | | Steel Properties | | | | |
|---|---|---|---|---|---|---|---|---|---|---|
| | Example No. | Steel No. | Temperature (°C.) | Time (min.) | Cooling rate (°C./s) | Amount of martensite (%) | Martensite grain size (μm) | Hardness (HV) | Elongation (%) | Bendability*1 |
| Inventive | 10 | 1 | 1000 | 3 | 50 | 38 | 8 | 231 | 29 | ○ |
| | 11 | 2 | 980 | 3 | 50 | 52 | 7 | 276 | 16 | ○ |
| | 12 | 3 | 950 | 3 | 20 | 50 | 5 | 323 | 14 | ○ |
| | 13 | 4 | 1000 | 5 | 20 | 64 | 5 | 335 | 14 | ○ |
| | 14 | 5 | 1050 | 5 | 10 | 82 | 5 | 388 | 12 | ○ |
| | 15 | 6 | 950 | 3 | 20 | 75 | 5 | 352 | 11 | ○ |
| | 16 | 7 | 1000 | 3 | 20 | 89 | 5 | 426 | 10 | ○ |
| Comparative | 6 | 8 | 1000 | 3 | 20 | 58 | 14 | 297 | 15 | X |
| | 7 | 6 | 800*2 | 3 | 20 | 0 | — | 151 | 28 | ○ |
| | 8 | 6 | 1000*3 | 3 | 20 | 72 | 20 | 343 | 12 | X |

*1Ability to be bent over flat along with rolling direction along the ridge line
○: No problem
X: Cracks
*2Annealing at ferrite zone
*3Strip of Example No. 7, subjected to dual-phase heat treatment after annealing As can be seen from Table 3, in accordance with the process of this invention, high strength duplex structure steel strips were obtained that exhibited good workability and elongation, having an average martensite grain diameter of not more than 10 μm. In contrast, owing to low Ni, Mn and Cu contents, the Ni+(Mn+Cu)/3 value of comparative example No. 6 (steel No. 8) was 0.13, lower than the range according to the present invention, resulting in a relatively large formed martensite grain size of 14 μm, hence poor bendability. Comparative example No. 7 (steel No. 6) was subjected to dual-phase heat treatment at a low temperature of 800° C., whereby annealing took place at a ferrite region and martensite formation did not take place, resulting in low strength. Comparative example No. 8 was given this annealing and then subjected to further dual-phase heat treatment at 1000° C. However, this releases processing stresses imposed by the cold rolling, causing austenite to form at recrystallized ferrite grain boundaries. This coarsens the martensite formed by the cooling, degrading the bendability.

Thus, as described in the foregoing, in accordance with the process of this invention, high strength stainless steel sheet materials having a hardness of at least HV 200 and exhibiting good elongation as well as good workability, can be commercially and economically produced in the form of steel strips, and as such can be widely applied in fields such as electronic instruments and precision machine parts in which high strength and workability are required.

What is claimed is:

1. A stainless steel of a duplex structure, comprised of from 60% to 95% by volume of martensite having an average grain diameter of not more than 10 μm, with the a balance being essentially ferrite, said steel having a high strength and an elongation as well as a hardness of at least HV 320, said steel comprising, by weight:

up to 0.10% C, up to 2.0% Si, up to 4.0% Mn, up to 0.040% P, up to 0.010% S, up to 4.0%Ni, from 10.0% to 20.0% Cr, up to 0.12% N;

more than 0.0050% to 0.0300%B, up to 0.02% O, and up to 4.0% Cu, the balance being Fe and unavoidable impurities, and satisfying $0.01\% \leqq C+N \leqq 0.20\%$ $0.20\% \leqq Ni+(Mn+Cu)/3 \leqq 5.0\%$ and the content amounts of C, N, Ni, Mn, Cu, Cr and Si in the steel satisfy a relationship for a γmax value of more than 65 and not more than 95, obtained from the equation $$\gamma max=420\ (\%C)+470\ (\%N)+23\ (\%Ni)+7\ (\%Mn)+9\ (\%C)-11.5\ (\%Cr)-11.5\ (\%Si)+189.$$

2. The stainless steel of claim 1 wherein the steel further comprises one or more selected from up to 0.20% A1, up to 3% Mo, up to 0.20% REM, up to 0.20% Y, up to 0.10% Ca and up to 0.10% Mg.

3. A process for the production of a stainless steel of a duplex structure, comprised of from 60% to 95% by volume of martensite having an average diameter not more than 10 μm, with the balance being essentially ferrite, said steel having high strength and elongation as well as a hardness of at least HV 320, which process comprises;

a step of hot rolling a slab of a steel by rough rolling and finish rolling to provide a hit rolled strip, said steel comprising, by weight, up to 0.10% C, up to 2.0% Si, up to 4.0% Mn, up to 0.040% P, up to 0.010% S, up to 4.0% Ni, from 10.0% to 20.0% Cr, up to 0.12% N, more than 0.0050% to 0.0300%B, up to 0.02% O, and up to 4.0% Cu, the balance being Fe and unavoidable impurities, and satisfying $0.01\% \leqq C+N \leqq 0.20\%$ $0.20\% \leqq Ni+(Mn+Cu)/3 \leqq 5.0\%$ and the content amounts of C, N, Ni, Mn, Cu, Cr and Si in the steel satisfy a relationship for a γmax value of more than 65 and not more than 95, obtained from the equation $$\gamma max = 420(\%\ C) + 470(\%\ N) + 23(\%\ Ni) + 7(\%\ Mn) + 9(\%\ C) - 11.5(\%\ Cr) - 11.5(\%\ Si) + 189.$$

a step of cold rolling the hot rolled strip to provide a cold rolled strip, and a step of dual-phase heat treatment in which the cold rolled strip is passed through a heating zone where it is heated to a temperature ranging from at least about 100° C. above the Ac1 point of the steel to 1100° C. to form a two-phase of ferrite and austenite and maintained at that temperature for not longer than 10 minutes, and the heated strip is cooled from the maximum heating temperature to ambient temperature at an average cooling rate of at least 1° C./s to not more than 1000° C./s.

4. The process in accordance with claim 3 wherein the rough rolling of the hot rolling step is carried out in three or more passes at a reduction rate of not less than 30% per pass, the duplex structure is comprised of from 60% to 95% by volume of martensite having an average grain diameter of not more than 10 μm, with the balance being essentially ferrite, the hardness is at least HV 320 and the content amounts of C, N, Ni, Mn, Cu, Cr, and Si in the steel satisfy a relationship for a γmax value of more than 65 to not more than 95, obtained from the equation $$\gamma max = 420(\%\ C) + 470(\%\ N) + 23(\%\ Ni) + 7(\%\ Mn) + 9(\%\ Cu) - 11.5(\%\ Cr) - 11.5(\%\ Si) + 189.$$

5. A process for the production of a stainless steel of a duplex structure, comprised of from 60% to 95% by volume of martensite having an average grain diameter of not more than 10 μm, with the balance being essentially ferrite, having high strength and elongation as well as a hardness of at least HV 320, which process comprises:

a step of hot rolling a slab of a steel by rough rolling and finish rolling to provide a hot rolled strip, said steel comprising, by weight, up to 0.10% C, up to 2.0% Si, up to 4.0% Mn, up to 0.040% P, up to 0.010% S, up to 4.0% Ni, from 10.0% to 20.0% Cr, up to 0.12% N, more than 0.0050% to 0.0300% B, up to 0.02% O, and up to 4.0% Cu, the balance being Fe and unavoidable impurities, and satisfying $0.01\% \leqq C+N \leqq 0.20\%$ $0.20\% \leqq Ni+(Mn+Cu)/3 \leqq 5.0\%$.

a step of cold rolling the hot rolled strip to provide a cold rolled strip, and a step of dual-phase heat treatment in which the cold rolled strip is passed through a heating zone where it is heated to a temperature ranging from at least 100° C. above the $Ac_1$ point of the steel to 1100° C. to form a two-phase of ferrite and austenite and maintained at that temperature for not longer than 10 minutes, and the heated strip is cooled from the maximum heating temperature to ambient temperature at an average cooling rate of at least 1 ° C./s to not more than 1000° C./s.

6. The process in accordance with claim 5 wherein the rough rolling of the hot rolling step is carried out in three or more passes at a reduction rate of not less than 30% per pass, and the content amounts of C, N, Ni, Mn, Cu, Cr, and Si in the steel satisfy a relationship for a γmax value of more than 65 to not more than 95, obtained from the equation $$\gamma max = 420(\%\ C) + 470(\%\ N) + 23(\%\ Ni) + 7(\%\ Mn) + 9(\%\ Cu) - 11.5(\%\ Cr) - 11.5(\%\ Si) + 189.$$

7. The process of claim 5 wherein the boron lower limit is 0.0061%.

8. The stainless steel of claim 1 wherein the boron lower limit is 0.0085%.

9. The process of claim 3 wherein the boron lower limit is 0.0085%.

* * * * *